US006846025B2

(12) United States Patent
Sclater et al.

(10) Patent No.: US 6,846,025 B2
(45) Date of Patent: Jan. 25, 2005

(54) LATCHING MECHANISM

(75) Inventors: Peter Gordon Sclater, Wellington (NZ); Matthew Stephen John Pack, Wellington (NZ); Howard John Fountaine, Hamilton (NZ)

(73) Assignee: Assa Abloy Financial Services AB (SE)

( * ) Notice: Subject to any disclaimer, the term of this patent is extended or adjusted under 35 U.S.C. 154(b) by 1 day.

(21) Appl. No.: 10/328,825

(22) Filed: Dec. 23, 2002

(65) Prior Publication Data

US 2003/0168867 A1 Sep. 11, 2003

(30) Foreign Application Priority Data

Dec. 24, 2001 (NZ) ..... 516359

(51) Int. Cl.[7] ..... E05C 3/00
(52) U.S. Cl. ..... 292/336.3; 292/138; 292/145
(58) Field of Search ..... 292/336.3, 138, 292/145, 73, 75, 150, 152, 153, 173, 175, 193

(56) References Cited

U.S. PATENT DOCUMENTS 857,922 A * 6/1907 Campbell ..... 292/27
1,861,579 A * 6/1932 North ..... 292/335
2,098,569 A * 11/1937 Curtis ..... 292/42
3,871,198 A * 3/1975 Miller ..... 70/489
4,544,189 A * 10/1985 Fiordellisi et al. ..... 292/50
4,609,233 A * 9/1986 Walla ..... 312/219
5,171,048 A * 12/1992 Weinerman et al. ..... 292/45
5,174,618 A * 12/1992 Kropf ..... 292/254
5,177,988 A * 1/1993 Bushnell ..... 70/279.1
5,244,238 A * 9/1993 Lindqvist ..... 292/7
5,247,817 A * 9/1993 Korner et al. ..... 70/240
5,484,178 A * 1/1996 Sandhu et al. ..... 292/173
5,531,086 A * 7/1996 Bryant ..... 70/279.1
5,935,729 A * 8/1999 Mareno et al. ..... 429/100
6,264,257 B1 * 7/2001 Meinke ..... 292/336.3
6,546,671 B2 * 4/2003 Mitchell et al. ..... 49/185

* cited by examiner

*Primary Examiner*—Daniel P. Stodola
*Assistant Examiner*—Carlos Lugo
(74) *Attorney, Agent, or Firm*—Blakely Sokoloff Taylor & Zafman

(57) ABSTRACT

A latching mechanism which is primarily intended for use with hung and sliding window systems. The latching mechanism includes a body 10 and latch element 25, the latch element being moveable between a latching position and a non-latching position. The latch element 25 is coupled to a slider 36 which is moveable by an operating slide 13 mounted with lock furniture 11. The slide element 13 is coupled to the slider 36 by a lost motion member 34 which is operable to release a snap hook from engagement with the slider 36 prior to the slider 36 being moved from its latching position.

19 Claims, 6 Drawing Sheets

LATCHING MECHANISM

BACKGROUND TO THE INVENTION

This invention relates to a latching mechanism. More particularly the latching mechanism is intended, though not exclusively, for hung and sliding window systems.

Hung and sliding windows are commonly fitted with rotary cam style locking mechanisms mounted above or on the surface of the sash rails for locking the window system. The latch commonly requires a rotary motion to actuate the mechanism. The rotary style actuator requires that part of the mechanism housing be visually exposed which can be aesthetically unpleasing or that the rail be altered to allow the rotary cam to be inset into the top of the sash rail. The method of actuation of rotary styled operators generally involve the use of lever ratios. In addition rotary cam style operators typically use screw fasteners or the like to mount the latch to the sash profile.

In the interest of security a latching mechanism for window systems preferably must be such as to ensure that the latch cannot be opened from the exterior of the window system. This ensures that someone from outside the window system cannot achieve unauthorised entry through the window. It is therefore known to provide constructions whereby the latch element when in the latching position is somehow shrouded or blocked from access so as to prevent someone from outside the window system manipulating the latch so as to release the latching mechanism.

SUMMARY OF THE INVENTION

It is an object of the present invention to provide a latching mechanism whereby means within the latching mechanism for causing movement of the latch element between latching and non-latching positions is only operable from the interior of the window system when moving the latch element from its latching position.

Broadly according to one aspect of the present invention there is provided a latching mechanism including a body, a latch element movable between a latching position and a non-latching position, moving means for causing movement of the latch element between said latching and non-latching positions, retention means for retaining the moving means when the latch element is in said latching position, operating means for imparting movement to the moving means and lost motion means whereby in use the operating means causes release of the retention means to enable movement of the moving means to occur.

In a preferred form of the invention the latching mechanism further includes an externally accessible operating member coupled to the moving means. The operating member can be a slide element which is, in use, coupled with said moving means. The slide element can be slidingly engaged with a mounting member which is mountable in a snap lock arrangement over said opening in the window extrusion. The coupling between the slide element and the moving means can be formed by inter-engagement of a projection into a receiving element.

According to a preferred form of the invention the moving means can be formed by a slider retained for rectilinear motion within the body. The slider can be connected to the operating member via the lost motion driving member.

In a preferred form of the invention the retention means is a snap hook which snap locks with an engagement part of the slider when the slider moves to the latching position. The lost motion means can be a release member moveably mounted with the slider and has an engagement surface which is engageable with the snap hook to move the snap hook from engagement with the engagement part of the slider.

In a further form of the invention the latching mechanism can include a second retention means for retaining the moving means when the latch element is in the non-latching position.

Preferably the latching mechanism further includes an anti-slam mechanism. The anti-slam mechanism can include a pin biased to project from the body and lockingly engage with part of the slider when the slider is in the non-latching position. Movement of the pin against the biasing action releases the slider to enable the slider to move from the non-latching position.

DETAILED DESCRIPTION OF A PREFERRED EMBODIMENT OF THE INVENTION

Figure 1:
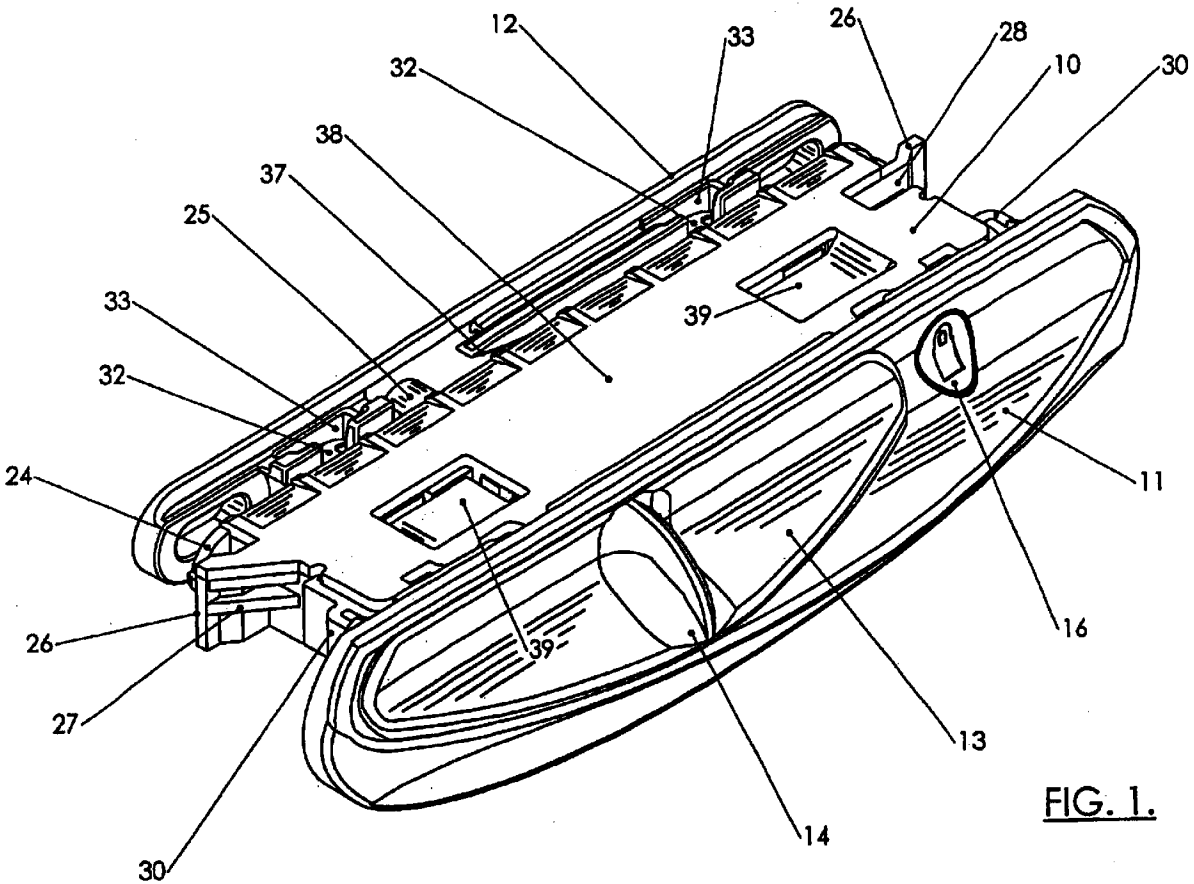
FIG. 1 is a perspective illustration of the assembled latching mechanism when in the "unlocked" position with a strike.
Figure 9:
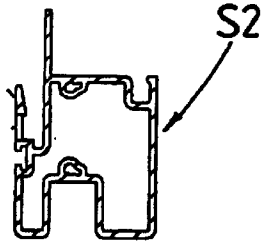
FIG. 9 is a section on line B—B of FIG. 8.

As can be seen, for example in FIG. 1, the latching mechanism includes a body or housing 10, latch furniture 11 and a strike 12. As will hereinafter be described the strike 12 is face mounted to a sash or frame element S2 (see FIGS. 8 and 9) while the housing 10 is located within an extruded element of sash S1 (see FIGS. 6 and 7). Sash/frame S2 and sash rail S1 will typically be part of a hung or sliding window system. The latch furniture 11 is face mounted to the sash 51 and co-operates with the mechanism within the housing 10.

Figure 4:
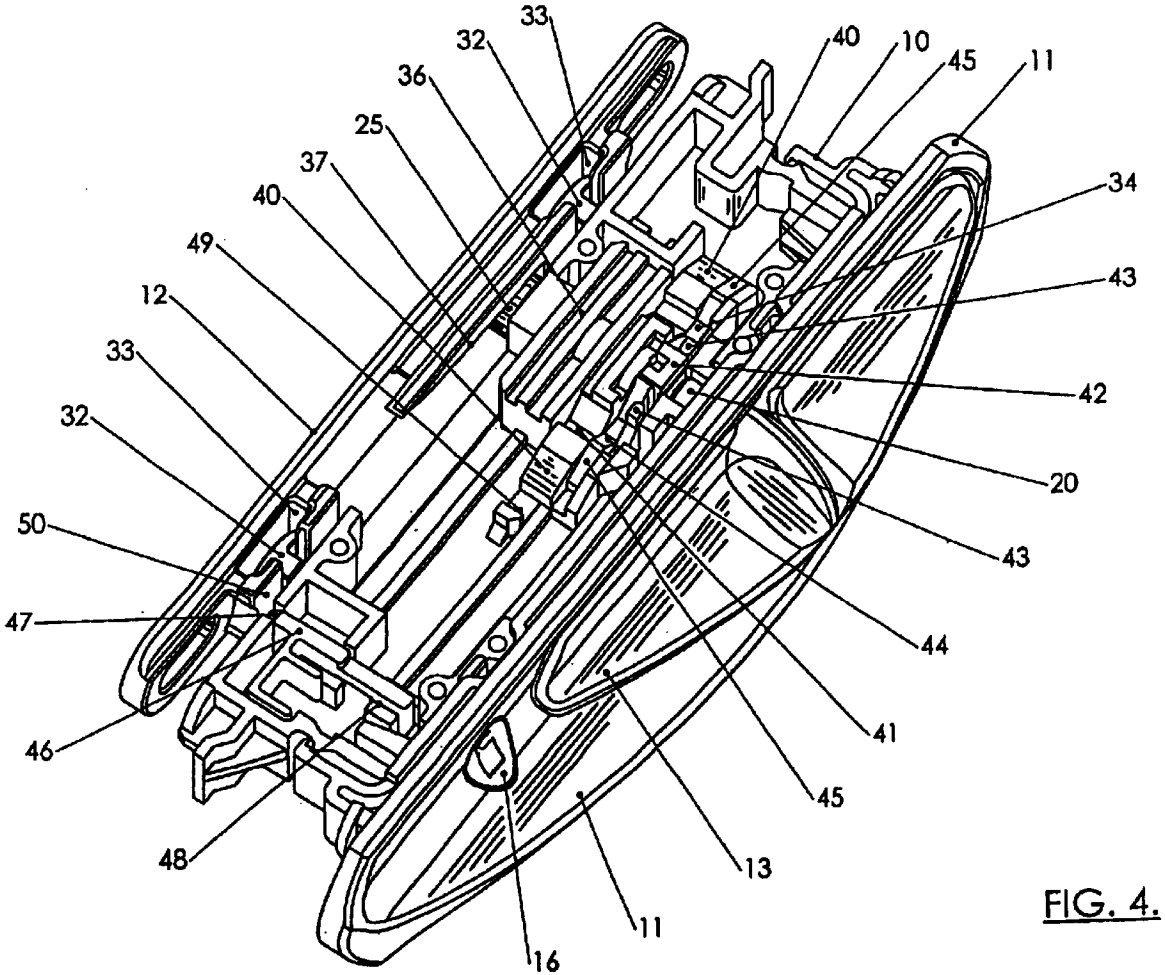
FIG. 4 is yet a similar view but showing the latching mechanism in the locked position.
Figure 5:
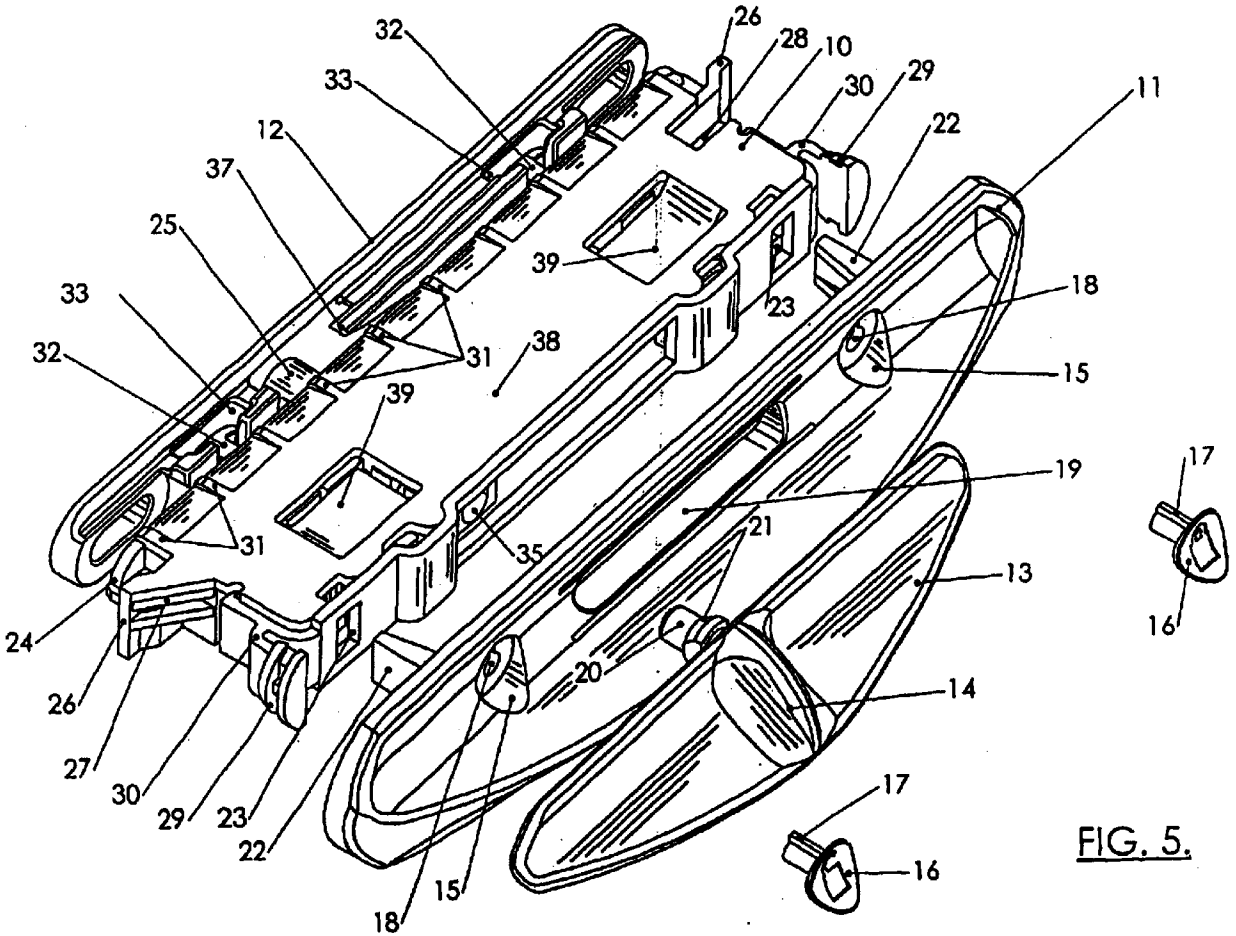
FIG. 5 is a perspective exploded view of the latching mechanism.

The latch furniture 11 includes a slide element 13 which can move from the unlatched position, as shown in for example FIG. 1, to a latched position as shown in FIG. 4. The slide element 13 is manipulated by the cover via a profiled or shaped projection 14.

The latch furniture 11 includes a pair of recesses 15 in which an indicator plug 16 can be installed. This can be achieved by an interference fit of peg 17 of the indicator 16 in an opening 18 of the recess 15. Each of plugs 16 includes a graphic illustration of a lock e.g. a padlock in a locked configuration and in the unlock configuration.

Thus, for example in FIG. 1 the locked indicator 16 shows the position to which the slide element 13 must be slid to effect latching. As shown in FIG. 4 the unlocked indicator 16 shows the position to which the slide element 13 needs to be slid in order to move the latching mechanism to the unlatched position.

The latch furniture 11 includes an elongate opening 19 through which projects a pin 20. The pin 20 includes a shoulder 21 which when the pin 20 is installed with slide element 13 retains the slide element 13 in a sliding mounted position with the latch furniture 11.

The latch furniture 11 is push fitted to the housing 10 by a pair of snap lugs 22 which interference fit in openings 23 in the housing 10. When so fitted the pin 20 engages with the latching mechanism within the housing 10 as will hereinafter be explained.

Figure 7:
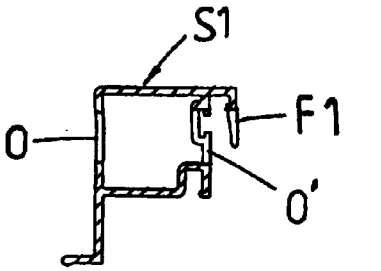
FIG. 7 is a section on line A—A of FIG. 6.
Figure 6:
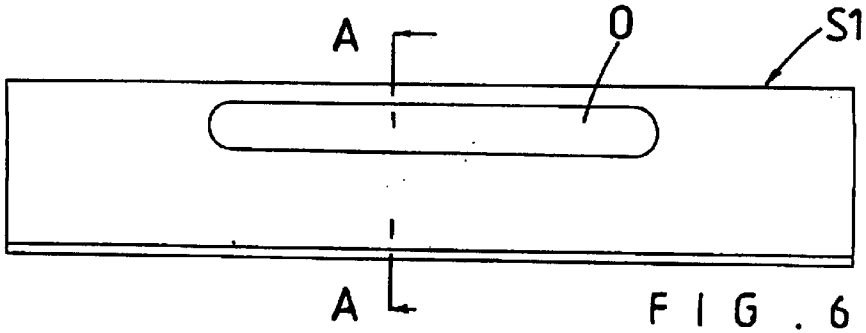
FIG. 6 is a part length view of a sash extrusion with routings to enable the latching mechanism to be located there within.
Figure 8:
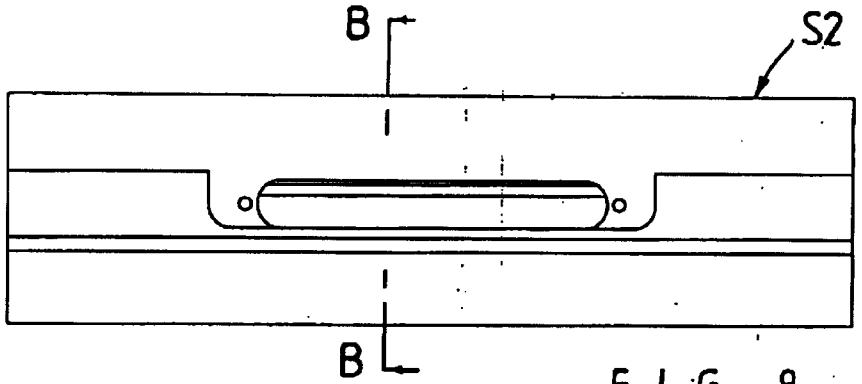
FIG. 8 is a part length view of an extrusion forming part of the sash/frame of a hung or sliding window system showing routing for the strike.

As shown in FIGS. 6 and 7 the sash element or rail S1 is routed to provide two opposing openings O and O'. The latch mechanism is installed by inserting housing 10 through opening O so that the front face 24 of the housing 10 locates in opening O'. As can be seen in FIG. 7 the routing operation also removes a corresponding shaped part of flange F1 of the sash rail S1. This part which is removed provides a clearance for the roller/pin assembly 25 of the latch mechanism.

The latch housing 10 is installed within the sash profile S1 without any screws, using only snap fit fasteners inbuilt into the housing. Adjacent the front face 24 of the latch housing 10 are a pair of feet 26. A sloping face 27 extends backwardly from one of the feet 26 while the other of the feet 26 has a space 28 located there behind. This arrangement enables the housing 10 to be installed within the sash S1 even though the openings O and O' are of common width and length. Thus the housing 10 can be canted to enable one leg to be installed within the profile and then the other leg move through opening O before the housing is straightened up and moved forward until the feet 26 engage either end of opening O'.

The snap fit fasteners mentioned above comprise spring legs 30 extending from the sides of the housing 10 and terminating in retention ends 29 each formed by a pair of spaced apart profiled flanges which engage either side of the respective ends of the opening O'. Thus the two feet 26 at the front of the latch housing 10 prevent the latch housing from moving out through the opening O' while the latch housing itself is retained rigidly in the sash profile S1 by the use of the snap fit fasteners 29 located at the back edge of the latch housing 10.

Burrs are a common problem in routed slots or openings such as openings O and O'. With the present invention this problem is overcome through the use of a plurality of ribs 31 along the front face 24 of the housing. This ribbed lead-in therefore allows for varying tolerances in the slot width and for burrs produced during the slot manufacturing process.

With the housing 10 in place in sash profile S1 the latch furniture 11 is mounted on to the back of the housing using the snap lugs 22 as previously described. Thus no fixing screws are required for either mounting the latch housing 10 or the furniture 11. The latch housing is thus fully contained within the sash profile. The slot or opening O is fully covered by the furniture 11. A further advantage of this arrangement is that the furniture 11 can be removed when needed and for example allows the furniture 11 to be readily interchanged for changing consumer tastes or design trends.

Figure 2:
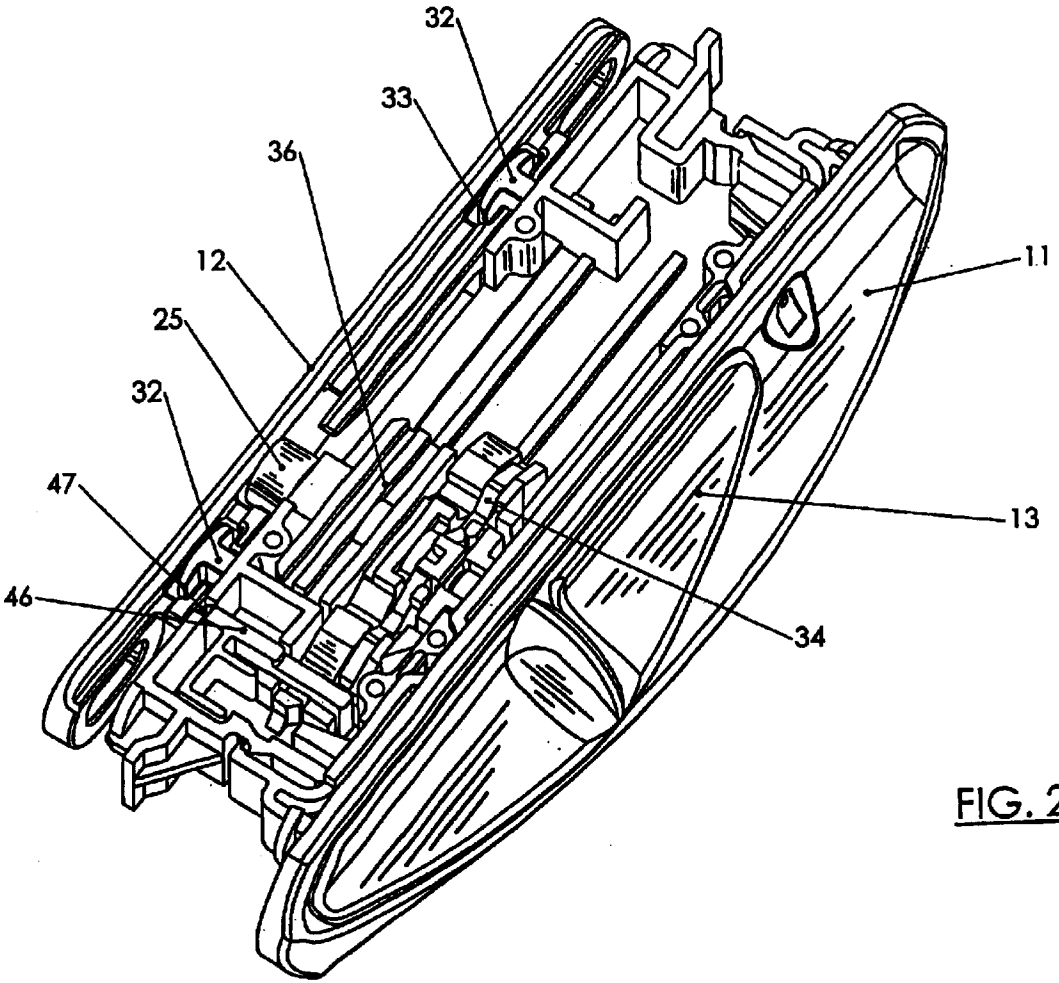
FIG. 2 is a view similar to FIG. 1 but with the cover of the body removed and prior to full engagement between the latching mechanism and the strike.

On the front face 24 of the latch housing 10 are a pair of cleats 32 which in the closing of the window system engage into hooks 33 forming part of the strike 12. This arrangement can be seen for example in FIGS. 2 and 3 with the latter showing the cleats in the fully located position with strike 12. As the cleats 32 engage into hooks 33 on the strike 12 the window sashes or sash and frame are pulled relatively together, thereby preventing rattling of the window. Also these features function to provide better security because they prevent the sashes or sash and frame being moved apart by externally applied forces by someone trying to make unauthorised entry through the window.

The present invention employs a linear latching mechanism. In the preferred form of the invention the pin 20 engages with a lost motion-overdriving member 34 by fitting within an opening 35 in the lost motion member 34. This lost motion member 34 in turn drives a carriage 36 which carries the roller/pin assembly 25.

Figure 3:
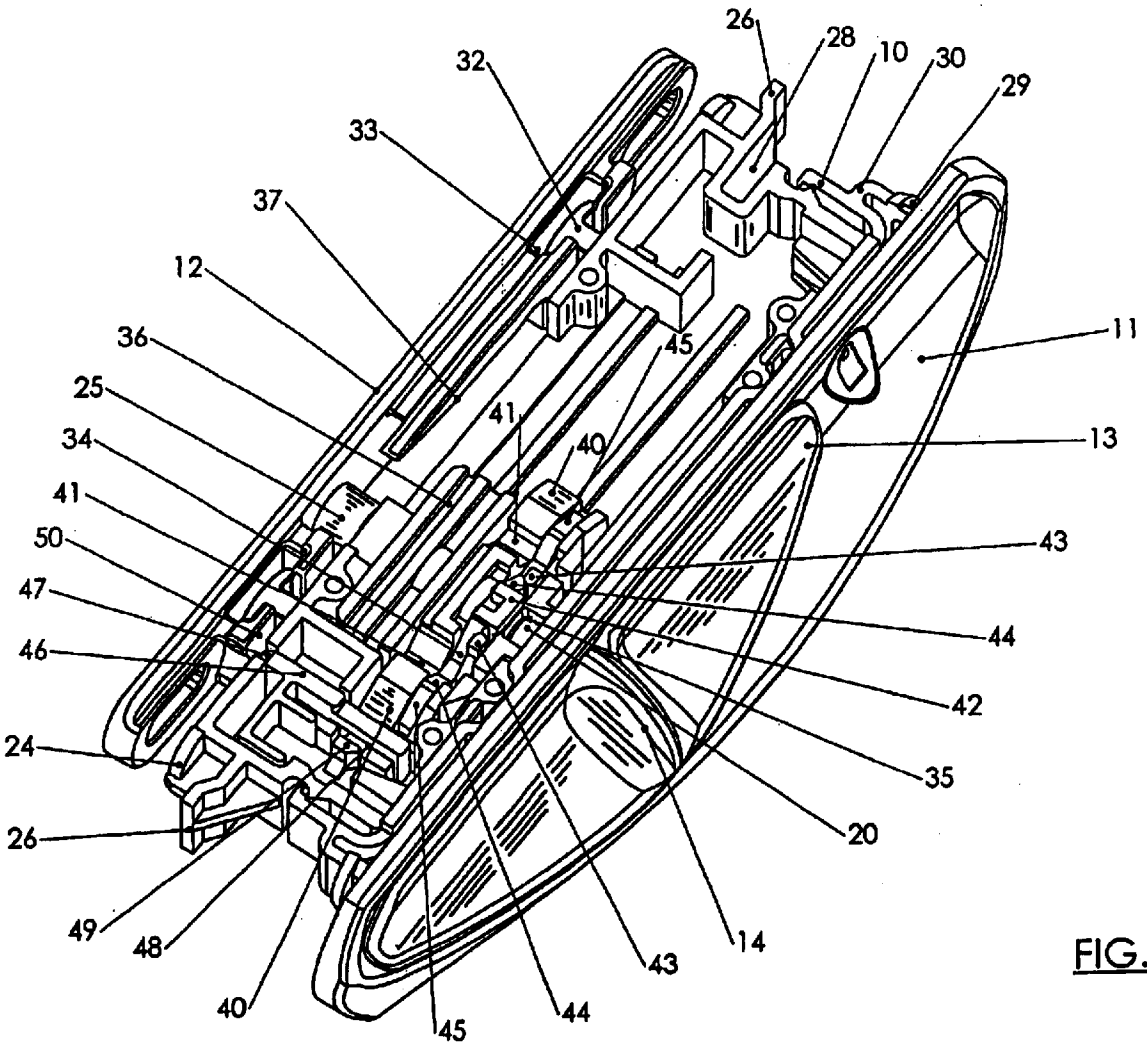
FIG. 3 is a view similar to FIG. 2 but with the latching mechanism in the unlocked position but fully engaged with the strike.

In order to provide the necessary output forces while satisfying the need for moderate to low operating forces the roller/pin assembly 25 passes along a cam profile 37 on the underside of the strike 12. As shown in FIG. 3 the roller 25 is in the non-latching position while FIG. 4 shows the carriage 36 having moved to the latching position whereby the roller/pin assembly 25 has moved along under the cam profile 37 to its final latching position.

Thus in the latched position the cleats 32 on the front of the latch housing 10 hook into the slots 33 of the strike 12 preventing the sashes from parting. The roller/pin assembly 25 when under the cam 37 and the strike 12 consequently prevents the sashes from sliding relatively apart. Thus the cleats and roller/pin assembly engaging with the strike prevents the sashes from opening.

The latch housing 10 includes a cover 38. Extending downwardly from the cover 38 are a pair of snap hooks 39. These snap hooks 39 "catch" the carriage 36 at either end of its operational stroke. These therefore prevent the carriage 36 from moving unless actuation of the lost motion-overdriving member 34 has occurred.

The carriage 36 includes a pair of sloping leading edges 40. During movement of the carriage 36 to each end of its operational stroke the leading surface 40 will engage with the snap hook 39 adjacent the end of the operational stroke. This causes the snap hook 39 to ride over the inclined surface 40 and then snap lock into the area 41 behind the sloping edge 40. The carriage thus becomes locked at the extreme end of its operational stroke.

The lost motion-overdriving member 34 is able to move relative to the carriage 36 but is limited in its extent of movement by turret 42 contacting one or either of posts 43 fixed with the carriage 36. The lost motion overdriving member 34 also includes a pair of opposed inclined surfaces 44.

Thus taking FIG. 3 by way of example the initial movement of slide element 13 of the latch furniture 11 causes only movement of the lost motion-overdriving member 34. This will result in turret 42 moving from contact with one post 43 to the other post 43. During such movement incline surface 44 will engage with and cause the snap hook 39 to move out of engagement with recess 41 of the carriage 36. Upon the turret 42 coming into contact with the other of the post 43 a driving force will be transmitted from the slide element 13 to the carriage 36 thereby causing the carriage to slide toward the other end of its operational stroke i.e. into the latching position where the roller/pin assembly 25 has moved under cam profile 37 and into the latching position as shown in FIG. 4.

It will be also observed that lost motion-overdriving member 34 has a further pair of inclined surfaces 45 which locate respectively in the same plane as surfaces 40 of the carriage 36.

The reverse procedure occurs when moving the slide element 13 from the position shown in FIG. 4 back to the position as shown in FIG. 3 i.e. there is firstly a lost motion-action which causes the snap hook 39 to release the carriage 36 and then enable the carriage to move so that the roller 25 moves back to the non-latching position.

To prevent damage to sash profiles and to the latch should the user close the window with the latch in the "closed" position an anti-slam mechanism is incorporated within the latch housing 10. This anti-slam mechanism prevents the latch from being operated when the window system is open. It ensures that the latch and strike must be in close proximity before the latch can be operated.

An anti-slam pin 46 projects (see FIG. 2) from the front 24 of the housing 10. As the latch housing 10 moves into the position where the cleats 32 are fully located within hook slots 33 the leading end 47 of the pin 46 engages with surface 50 of the part of the strike which forms one of the hook slots 33. This causes the pin 46 to slide back into the housing 10 (see FIG. 3). When the strike 12 lines up with the housing 10 the anti-slam pin 46 is fully depressed and this moves a surface 48 on the inner end of the pin 46 from behind a tongue 49 of the carriage 36. This frees the carriage 36 to be able to freely move via operation of the slide element 13.

When the window opens again the anti-slam pin 46 (which is under a spring bias) once again hooks behind the tongue 49 to prevent operation until the window is once again closed.

The latching mechanism according to the present invention thus enables installation to take place without any fixing screws either for the latch housing 10 or the furniture 11. Furthermore, the latching mechanism is concealed within the window extrusion.

Good security features are exhibited by the latching mechanism in part due to the locking of the carriage at each end of its operational stroke so that when in the latched position the carriage is prevented from moving without actuation of the lost motion-overdriving member. This ensures that the latch cannot be opened from the exterior of the window system.

The presence of the anti-slam mechanism prevents damage to sash profiles and the latch in the event that a user may endeavour to close the window with the lock in the closed position.

It will be appreciated by those skilled in the art that the features of the present invention are shown incorporated in a particular embodiment of the latching mechanism. It will thus be apparent that the mechanism is open to modification within the scope of the present invention.

What is claimed is:

1. A latching mechanism including a body, a latch element movable between a latching position and a non-latching position, a slider retained for rectilinear motion within the body for causing movement of the latch element between said latching and non-latching positions, a retainer for retaining the slider when the latch element is in said latching position, said retainer being biased to engage with an engagement part of the slider when the slider moves to said latching position to retain said slider in the latching position, an operating member external of the body and coupled to the slider via a lost motion connection between the operating member and slider whereby in use the operating member imparts movement to the slidably to disengage the retainer from the engagement part and thereby release the slider such that movement of the slider can occur.

2. A latching mechanism as claimed in claim 1 wherein the lost motion connection is a release member movably mounted with the slider, said release member including an engagement surface which is engageable with the retainer to move the retainer from engagement with the engagement part of the slider.

3. A latching mechanism as claimed in claim 2 further including a second retainer for retaining the moving mechanism when the latch element is in the non-latching position.

4. A latching mechanism as claimed in claim 3 wherein the second retainer is engageable with a second engagement part of the slider, said release member having a second engagement surface engageable with the second retainer to release the second retainer from the slider in response to movement of the operator.

5. A latching mechanism as claimed in claim 1 further including an anti-slam mechanism.

6. A latching mechanism as claimed in claim 5 wherein the anti-slam mechanism is a pin which is biased to project from the body and lockingly engaged with a contact part of the slider when the slider is in the non-latching position, the pin having a clearance which aligns with the contact part of the slider to release the slider when the pin is moved from its projecting position.

7. A latching mechanism as claimed in claim 1 where the latch element is a roller element.

8. A latching mechanism as claimed in claim 7 in combination with a strike, the strike including a cam profile engageable with the roller element as the roller element moves to and from the latching and non-latching positions.

9. A latching mechanism as claimed in claim 8 wherein the body includes at least one projecting cleat and the strike includes a reception area for receiving the cleat when the strike and body are in relative positions which in use corresponds to a closure member with which the latching mechanism is mounted having been moved to a closed position.

10. A latching mechanism including a body, a latch element movable between a latching position and a non-latching position, a moving mechanism for causing movement of the latch element between said latching and non-latching positions, a retainer for retaining the moving mechanism when the latch element is in said latching position, latch furniture with which is slidably mounted a slide element the slide element being coupled to the moving mechanism via a lost motion connection between the slide element and moving mechanism whereby in use the slide element causes release of the retainer to enable movement of the moving mechanism to occur.

11. A latching mechanism as claimed in claim 10 wherein the cover includes indicators to indicate that the latch element is in the latching and non-latching positions, said slide element covering a respective one of the indicators depending on whether the latch element is in the latching or non-latching position.

12. A latching mechanism as claimed in claim 10 wherein the body includes a retention device to retain the body in a section of a frame when the body has been installed through a first opening and into the interior of the frame section.

13. A latching mechanism as claimed in claim 12 wherein the body includes a pair of spaced apart feet which in use engage with a perimeter surface of a second opening in the frame section, said second opening being disposed opposite said first opening.

14. A latching mechanism as claimed in claim 10 in combination with a window frame, said window frame including a pair of oppositely disposed openings, the body being located through a first opening into the interior of the frame, the body having a pair of feet which engage with the frame at the periphery of a second opening and snap fit fastener elements which engage with the said one opening.

15. The combination of claim 14 wherein the openings are of substantially the same dimensions.

16. The combination of claim 15 wherein the snap fit fastener comprises one or more spring legs which are formed as an integral part of the body.

17. The combination of claim 14 wherein a part of the body which engages with the second opening includes a plurality of ribs which are substantially transverse to the plane of the second opening.

18. A latching mechanism in combination with a strike the latching mechanism including a body, a latch element in the form of a roller element movable between a latching position and a non-latching position, the strike including a cam profile engageable with the roller element as the roller element moves to and from the latching and non-latching positions, a moving mechanism for causing movement of the latch element, a retainer for retaining the moving mechanism when the latch element is in said latching position, a slide element slidably mounted with a cover which is coupled to the body, the slide element being coupled to the moving mechanism via a lost motion connection between the slide element and moving mechanism whereby in use the slide element causes release of the retainer to enable movement of the moving mechanism to occur, the body including at least one projecting cleat and the strike includes a reception area for receiving the cleat when the strike and body are in relative positions which in use corresponds to a closure member with which the latching mechanism is mounted having been moved to a closed position.

19. A latching mechanism including a body which has a retention device to retain the body in a section of a frame when the body has been installed through a first opening and into the interior of the frame section, and a pair of spaced apart feet which in use engage with a perimeter surface of a second opening in the frame section, said second opening being disposed opposite said first opening, the latching mechanism further including a latch element movable between a latching position and a non-latching position, a moving mechanism for causing movement of the latch element between said latching and non-latching positions, a retainer for retaining the moving mechanism when the latch element is in said latching position, a slide element slidably mounted with a cover which is coupled to the body, the slide element being coupled to the moving mechanism via a lost motion connection between the slide element and moving mechanism whereby in use the slide element causes release of the retainer to enable movement of the moving mechanism to occur.

* * * * *

UNITED STATES PATENT AND TRADEMARK OFFICE

CERTIFICATE OF CORRECTION

PATENT NO. : 6,846,025 B2
DATED : January 25, 2005
INVENTOR(S) : Sclater et al.

It is certified that error appears in the above-identified patent and that said Letters Patent is hereby corrected as shown below:

Column 5,
Line 65, please delete "slidably" and insert -- moving member --.

Signed and Sealed this

Twenty-eighth Day of June, 2005

JON W. DUDAS
*Director of the United States Patent and Trademark Office*